US009327500B2

(12) United States Patent
Nagatoya et al.

(10) Patent No.: US 9,327,500 B2
(45) Date of Patent: May 3, 2016

(54) NOZZLE PLATE, LIQUID EJECTING HEAD, AND LIQUID EJECTING APPARATUS

(71) Applicant: SEIKO EPSON CORPORATION, Tokyo (JP)

(72) Inventors: Satoshi Nagatoya, Azumino (JP); Nobuhiro Naito, Chino (JP); Kosuke Wakamatsu, Chino (JP); Michiya Nakamura, Azumino (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/141,110

(22) Filed: Dec. 26, 2013

(65) Prior Publication Data

US 2014/0183284 A1 Jul. 3, 2014

(30) Foreign Application Priority Data

Dec. 27, 2012 (JP) ..... 2012-284496

(51) Int. Cl.
*B41J 2/14* (2006.01)
*B41J 2/16* (2006.01)

(52) U.S. Cl.
CPC ..... *B41J 2/1433* (2013.01); *B41J 2/14233* (2013.01); *B41J 2/162* (2013.01); *B41J 2/164* (2013.01); *B41J 2/1606* (2013.01); *B41J 2/1623* (2013.01); *B41J 2002/14241* (2013.01); *B41J 2002/14419* (2013.01)

(58) Field of Classification Search
None
See application file for complete search history.

(56) References Cited

U.S. PATENT DOCUMENTS

| | | | | |
|---|---|---|---|---|
| 2005/0001879 | A1 | 1/2005 | Miyajima et al. | |
| 2006/0244770 | A1 * | 11/2006 | Nishijima | 347/1 |
| 2010/0229390 | A1 * | 9/2010 | Sakashita | 29/890.1 |
| 2010/0245475 | A1 * | 9/2010 | Masashi et al. | 347/45 |

FOREIGN PATENT DOCUMENTS

| | | |
|---|---|---|
| JP | 2003-072086 | 3/2003 |
| JP | 2004-351923 | 12/2004 |
| JP | 2009-119724 | 6/2009 |
| JP | 2009-184176 | 8/2009 |

OTHER PUBLICATIONS

"Reactions of the GRoup VB Pentoxides with Alkali Oxides and Carbonates", Resiman, pp. 4514-4520, Sep. 20, 1956.*
Housmann, "Highly conformal atomic layer deposition of tantalum oxide using alkylamide precursors", 2003, Thin Film Solids 443, pp. 1-4.*
Niskanen, "Radical enhanced atomic layer deposition of tantalum oxide", 2007, Chem. Mater. 19, 2316-2320.*

* cited by examiner

*Primary Examiner* — Erica Lin
(74) *Attorney, Agent, or Firm* — Workman Nydegger

(57) ABSTRACT

A silicon nozzle plate has excellent liquid resistance on an inner surface of a nozzle opening and a discharge surface. A plurality of the nozzle openings are disposed in a silicon substrate of the nozzle plate. A tantalum oxide film formed by atomic layer deposition is disposed on both surfaces of the silicon substrate and the inner surface of the nozzle opening.

12 Claims, 6 Drawing Sheets

NOZZLE PLATE, LIQUID EJECTING HEAD, AND LIQUID EJECTING APPARATUS

BACKGROUND

1. Technical Field

The present invention relates to a nozzle plate having a nozzle opening to discharge liquid drops, and a liquid ejecting head and a liquid ejecting apparatus including the nozzle plate.

2. Related Art

In general, an ink jet type recording head known as a representative example of a liquid ejecting head includes a nozzle plate where a plurality of nozzle openings to discharge liquid drops are formed, and a passage forming substrate where a pressure generating chamber communicating with the nozzle opening is formed. In such liquid ejecting head, a silicon substrate is used in the passage forming substrate and the nozzle plate for an increase in nozzle density, and both thereof are bonded with each other by an adhesive agent.

JP-A-2009-184176 discloses a method for suppressing residual of the ink, in which a surface of a silicon nozzle plate bonded with the passage forming substrate and an inner surface of the nozzle opening are provided with a first ink-resistant protective film formed from an oxide silicon film by thermal oxidation, and a second ink-resistant protective film formed from metal oxide such as a tantalum pentoxide film formed by thermal CVD and plasma CVD and, further, a third ink-resistant protective film (base film) formed from metal oxide such as a tantalum pentoxide film formed by thermal CVD and plasma CVD and a liquid-repellent film (ink-repellent film) are formed on an ink discharge surface.

Also, JP-A-2004-351923 discloses a structure in which a base film such as a plasma-polymerized film of a silicone material and a liquid-repellent film disposed on the base film such as a metal alkoxide-polymerized molecular film are disposed as the liquid-repellent film of a nozzle discharge surface.

However, particularly in a case where the nozzle has high density, there is a case where a uniform film is unlikely to be formed on the inner surface of the nozzle opening, particularly up to the vicinity of the discharge surface, such that an ink resistance problem is likely to occur when the ink-resistant protective film formed of the metal oxide is disposed by CVD, and where film thickness is likely to be large and not uniform and a problem of non-uniformity of discharged ink drops arises when a sufficient film is to be formed over the entire surfaces. In a case where the above-described nozzle plate is a silicon nozzle plate in which a nozzle hole is formed on the silicon substrate by using anisotropic etching, there is a case where an adhesive property of the ink protective film causes a problem.

In addition, the base film such as the plasma-polymerized film of the silicone material of JP-A-2004-351923 has a possibility of generating microdefects, and there is a case where a problem such as peeling of the liquid-repellent film arises due to such microdefects.

SUMMARY

An object of the invention is to provide a nozzle plate that has excellent liquid resistance on an inner surface of a nozzle opening and a discharge surface, and a liquid ejecting head and a liquid ejecting apparatus using the nozzle plate.

An aspect of the invention is directed to a nozzle plate in which a plurality of nozzle openings are disposed in a silicon substrate, in which a tantalum oxide film formed by atomic layer deposition is disposed on both surfaces of the silicon substrate and an inner surface of the nozzle opening, and a plasma-polymerized film of a silicone material is stacked on the tantalum oxide film of a discharge surface.

According to this aspect, the tantalum oxide film that is film-formed by an atomic layer deposition is uniformly and densely formed even on a narrow area such as an inner circumferential surface of the nozzle opening, and functions effectively as the protective film against a strong alkaline liquid and a strong acid solution.

It is preferable that a thickness of the tantalum oxide film is within a range of 0.3 Å to 50 nm. In this case, liquid resistance is sufficiently ensured, and an open state in the nozzle opening is not affected.

It is preferable that a silicon thermal oxide film is formed in a lower layer of the tantalum oxide film. In this manner, liquid resistance can be further improved.

It is preferable that a liquid-repellent film is stacked on the plasma-polymerized film of the silicone material through annealing of a metal alkoxide film. In this case, liquid repellency of the discharge surface is further improved, high liquid resistance is ensured in a part where the liquid-repellent film is not formed in a boundary portion between an inner portion of the nozzle opening and an area in the vicinity of the nozzle opening where the liquid-repellent film is formed, and a problem such as peeling of the liquid-repellent film caused by a problem such as erosion of the silicon substrate by a liquid is addressed.

Another aspect of the invention is directed to a liquid ejecting head including the nozzle plate of the above aspect, a passage forming substrate where a pressure generating chamber that is bonded with the nozzle plate and communicates with the nozzle opening is disposed, and a pressure generation unit that is disposed on an opposite side to the nozzle plate of the passage forming substrate to generate a pressure change in the pressure generating chamber.

According to this aspect, the nozzle plate is excellent in liquid resistance and has no problem of peeling of the liquid-repellent film, and opening variation of the nozzle opening is small, and thus a liquid ejecting head with little discharge variation and excellent in durability can be achieved.

Still another aspect of the invention is directed to a liquid ejecting apparatus including the liquid ejecting head of the above aspect. According to this, a liquid ejecting apparatus with little discharge variation and excellent in durability can be achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiment 1

Figure 1A:
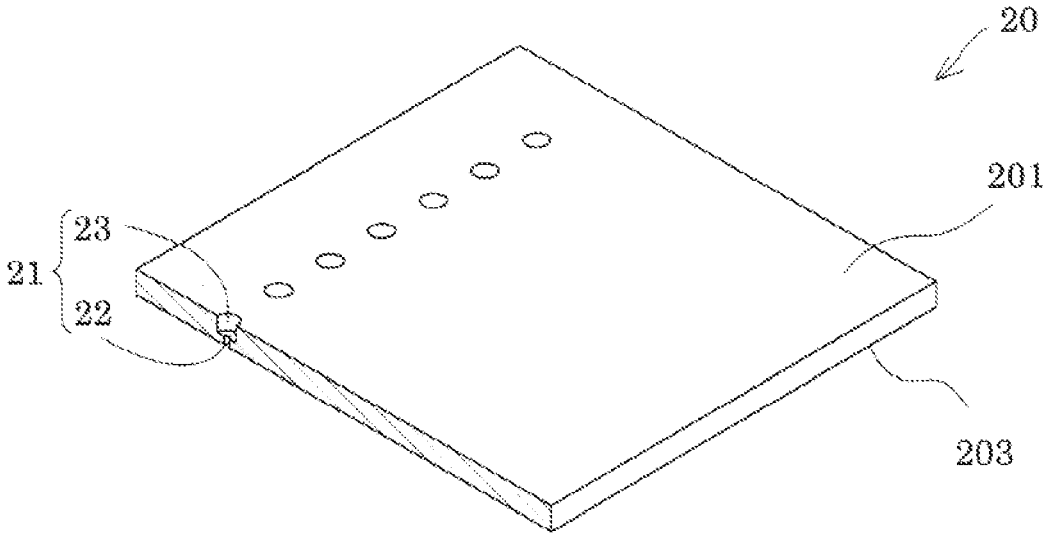
FIGS. 1A and 1B are a perspective view and an enlarged cross-sectional view of a main part of a nozzle plate according to Embodiment 1.
Figure 1B:
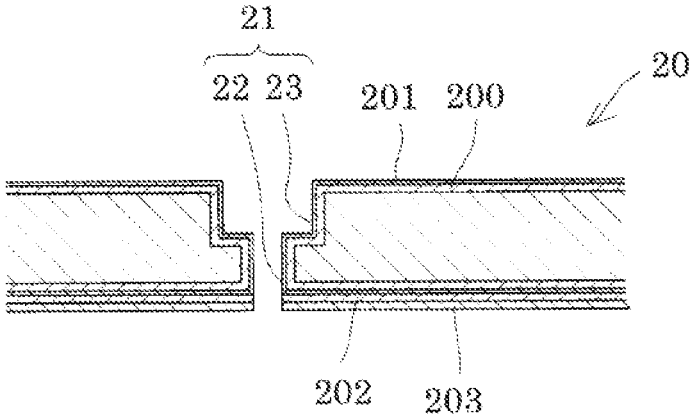

First, an example of a nozzle plate according to Embodiment 1 of the invention will be described. FIGS. 1A and 1B are a perspective view and an enlarged cross-sectional view of a main part of the nozzle plate according to Embodiment 1.

As shown in FIGS. 1A and 1B, the nozzle plate 20 is a member formed from a silicon single crystal substrate on which a plurality of nozzle openings 21 are formed in a row with a pitch corresponding to a dot formation density. In this embodiment, a nozzle array is configured such that the number of the nozzle openings 21 arrayed with a pitch of 180 dpi is 180. Each of the nozzle openings 21 is configured to have two successive cylindrical hole portions that are formed by dry etching and have different inner diameters. In other words, the nozzle opening 21 is configured to have a first cylindrical portion 22 that is formed on an ink discharge side in a plate thickness direction of the nozzle plate 20 and has a small inner diameter, and a second cylindrical portion 23 that is formed on an opposite side (ink passage side) from the ink discharge side and has a large inner diameter. The formation of the nozzle opening 21 is not limited to what is shown in the drawings. For example, the nozzle opening 21 may be configured to have a cylindrical portion (straight portion) with a constant inner diameter, and a tapered portion whose inner diameter is gradually increased from an ejection side toward the ink passage side. A silicon thermal oxide film 200 and a protective film 201 that is formed from a tantalum oxide film which is formed by atomic layer deposition are sequentially formed on both surfaces of the nozzle plate 20 and an inner circumferential surface of the nozzle openings 21. In addition, a plasma-polymerized film (plasma polymerization silicone (PPSi) film) 202 that is formed by plasma polymerization of a silicone material and a liquid-repellent film (silane coupling agent (SCA) film) 203 that is formed through a drying treatment, an annealing treatment, and the like after film formation of a molecular film of metal alkoxide having liquid repellency are sequentially stacked on an ink discharge side surface (hereinafter referred to as "discharge side surface") of the nozzle plate 20.

Herein, the silicon thermal oxide film 200 is formed by thermally oxidizing a silicon substrate, and is formed on both of the surfaces of the nozzle plate 20 and the inner circumferential surface of the nozzle opening 21. The thickness thereof is, for example, approximately 100 nm.

The thermal oxide film 200 does not necessarily need to be disposed. In this case, the protective film 201 is formed directly on the silicon substrate. Even in a case where the thermal oxide film 200 is not disposed, there is a case where a silicon natural oxide film is formed between the silicon substrate and the protective film 201, which is also included in the invention.

The protective film 201 contains tantalum oxide (TaOx) that is represented by tantalum pentoxide. The protective film 201 is formed by atomic layer deposition, can be formed to have a thin film thickness compared to a film which is formed by another gas phase method such as a CVD method, and can be formed with reliability and a uniform film thickness also on the inner circumferential surface of the small nozzle opening 21. Being formed by atomic layer deposition refers to being film-formed by an atomic layer deposition method (ALD method). Further, the ALD method has an advantage that the formation can have high film density. In other words, by forming the protective film 201 with high film density, the ink resistance (liquid resistance) of the protective film 201 can be improved such that erosion of the silicon substrate by ink (liquid) can be suppressed. In particular, the protective film 201 is formed with reliability and high film density even on the inner circumferential surface of the nozzle opening 21 vulnerable to an ink resistance problem and a corner portion of a boundary between a discharge surface side face and the nozzle opening 21, and thus the ink resistance of the nozzle plate 20 is significantly improved.

The thickness of the protective film 201 may be within a range of 0.3 Å to 50 nm, preferably within a range of 10 nm to 30 nm. The protective film 201 that is formed by the atomic layer deposition method in this manner is a film substantially thinner than an approximately 100 nm-thick film formed by a CVD method or the like. If the film is thinner than this, there is a possibility that the film is formed not to be completely uniform. If the film is thicker than this, the film formation becomes time-consuming and costly, which is not preferable, either.

Examples of materials of the plasma-polymerized film 202 include silicone oil, alkoxysilane, and the like, specifically dimethyl polysiloxane, and TSF451 (manufactured by GE Toshiba Silicones Co., Ltd.) and SH200 (manufactured by Toray Dow Corning Silicone Co., Ltd.) as products, which are plasma-polymerized by a film formation device for the film formation.

The liquid-repellent film 203 is a molecular film that is film-formed through the drying treatment, annealing treatment, and the like after film formation of metal alkoxide added with liquid repellency (water repellency and oil repellency).

Any metal alkoxide that has water repellency and oil repellency may be used as a material but, preferably, metal alkoxide that contains a long-chain polymer group (hereinafter referred to as "long-chain RF group") containing fluorine or metal acid salt having a liquid-repellent group is used. Examples of the metal alkoxide are various, using Ti, Li, Si, Na, K, Mg, Ca, St, Ba, Al, In, Ge, Bi, Fe, Cu, Y, Zr, Ta, and the like, but silicon, titanium, aluminum, zirconium, and the like are commonly used. In this embodiment, what uses silicon, preferably, alkoxysilane that contains the long-chain RF group containing fluorine or the metal acid salt having a liquid-repellent group, is used.

Examples of the long-chain RF group include a perfluoroalkyl chain and a perfluoropolyether chain whose molecular weight is at least 1,000.

Examples of the alkoxysilane having the long-chain RF group include a silane coupling agent having the long-chain RF group.

Examples of the silane coupling agent having the long-chain RF group suitable for the film formation of the liquid-repellent film 203 include hepta-fluoro-thoria conta dieicosyl trimethoxysilane. Examples of products include Optool DSX (trademark, manufactured by Daikin Industries, Ltd.) and KY-130 (trademark, manufactured by Shin-Etsu Chemical Co., Ltd.).

A fluorocarbon group (RF group) has smaller surface free energy than an alkyl group, and thus the liquid repellency of the liquid-repellent film that is formed can be improved and properties such as chemical resistance, weather resistance, and abrasion resistance can be improved by allowing the metal alkoxide to contain the RF group. The liquid repellency can better last when the long-chain structure of the RF group is long. Further, examples of the metal acid salt having the liquid-repellent group include aluminate and titanate.

Next, the nozzle plate 20, particularly processes of manufacturing the nozzle plate 20, will be described in detail.

FIGS. 2A to 2D are schematic views showing the processes of manufacturing the nozzle plate 20.

Figure 2A:
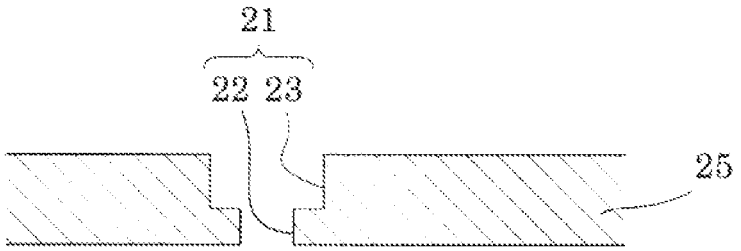
FIGS. 2A to 2D are views showing processes of manufacturing the nozzle plate according to Embodiment 1.

In this embodiment, the above-described silicon single crystal substrate (silicon substrate) 25 is used as the material of the nozzle plate 20, and a plurality of the nozzle plates 20 are manufactured from the one silicon substrate 25. As shown in FIG. 2A, the nozzle opening 21 formed from the first cylindrical portion 22 and the second cylindrical portion 23 is formed first by dry etching with respect to the silicon substrate 25.

Figure 2B:
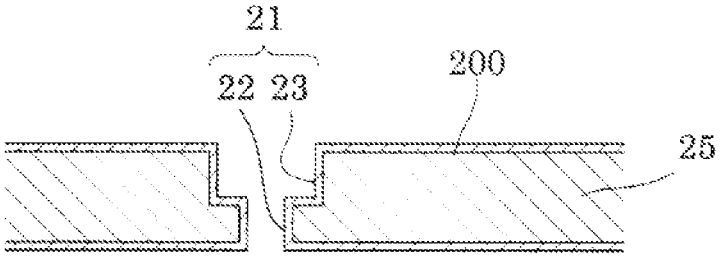

Next, as shown in FIG. 2B, the silicon thermal oxide film 200 is formed by a heat treatment on a discharge side surface (surface on a lower side in the drawing, hereinafter referred to as "first surface") on the ink discharge side, the surface (surface on an upper side in the drawing, hereinafter referred to as "second surface") on the opposite side from the surface, and the inner circumferential surface of the nozzle opening 21. The thermal oxide film 200 is formed of silicon dioxide, and the thickness thereof is approximately 100 nm.

A process of forming the thermal oxide film 200 may be omitted.

Figure 2C:
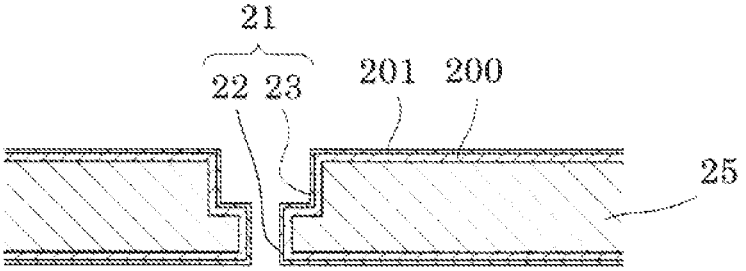

Next, as shown in FIG. 2C, the protective film 201 formed of tantalum oxide is film-formed by the atomic layer deposition method on the first surface on the ink discharge side, the second surface, and the inner circumferential surface of the nozzle opening 21. $H_2O$ or $O_3$ is used as an oxidizing agent during the film formation of the tantalum oxide by the atomic layer deposition method, and the film formation temperature is 120° C. to 350° C. The thickness of the protective film 201 may be within a range of 0.3 Å to 50 nm, preferably within a range of 10 nm to 30 nm since the film formation by the atomic layer deposition method is uniform and fine (high film density). $Ta_2O_5$ (TaOx) is alkali-soluble but is unlikely to be alkali-soluble when the film density is high (approximately 7 g/cm$^2$) and, in terms of acid resistance, is not soluble in a solution other than hydrofluoric acid, and thus the protective film is effective against a strong alkaline liquid and a strong acid solution.

Figure 2D:
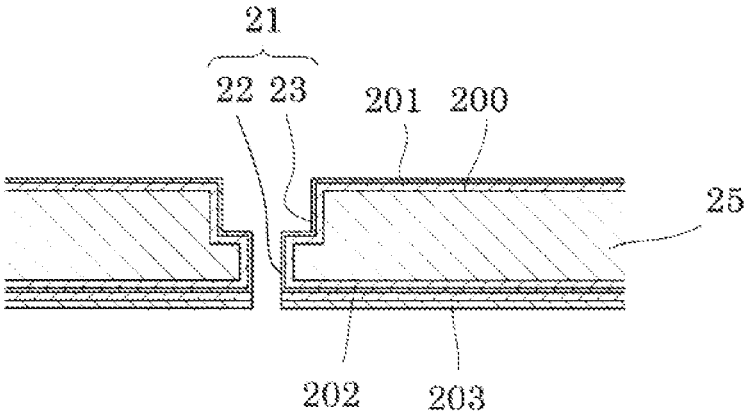

Subsequently, as shown in FIG. 2D, the plasma-polymerized film 202 formed by plasma polymerization of the silicone material is film-formed on the protective film 201 of the first surface, and the film formation of the molecular film of metal alkoxide having liquid repellency is performed on the plasma-polymerized film 202. Then, the liquid-repellent film 203 is formed through the drying treatment, the annealing treatment, and the like.

Herein, compared to the protective film 201, the plasma-polymerized film 202 and the liquid-repellent film 203 have high electrical insulation, and thus are formed only in an area other than a conductive area in a case where a conductive member is installed on the first surface for conduction. With regard to the conductive area, the plasma-polymerized film 202 and the liquid-repellent film 203 may be removed only in a related part after forming the liquid-repellent film 203 on the entire first surface, and the plasma-polymerized film 202 and the liquid-repellent film 203 may be prevented from being formed in the related part from the beginning by masking only the related part during the formation of the plasma-polymerized film 202 and the liquid-repellent film 203.

After the liquid-repellent film 203 is formed, the silicon substrate 25 is divided such that the plurality of nozzle plates 20 are obtained. The nozzle plates 20 are manufactured through this process.

Embodiment 2

Hereinafter, an ink jet type recording head that is an example of a liquid ejecting head using the nozzle plate 20 of Embodiment 1 described above will be described.

Figure 3:
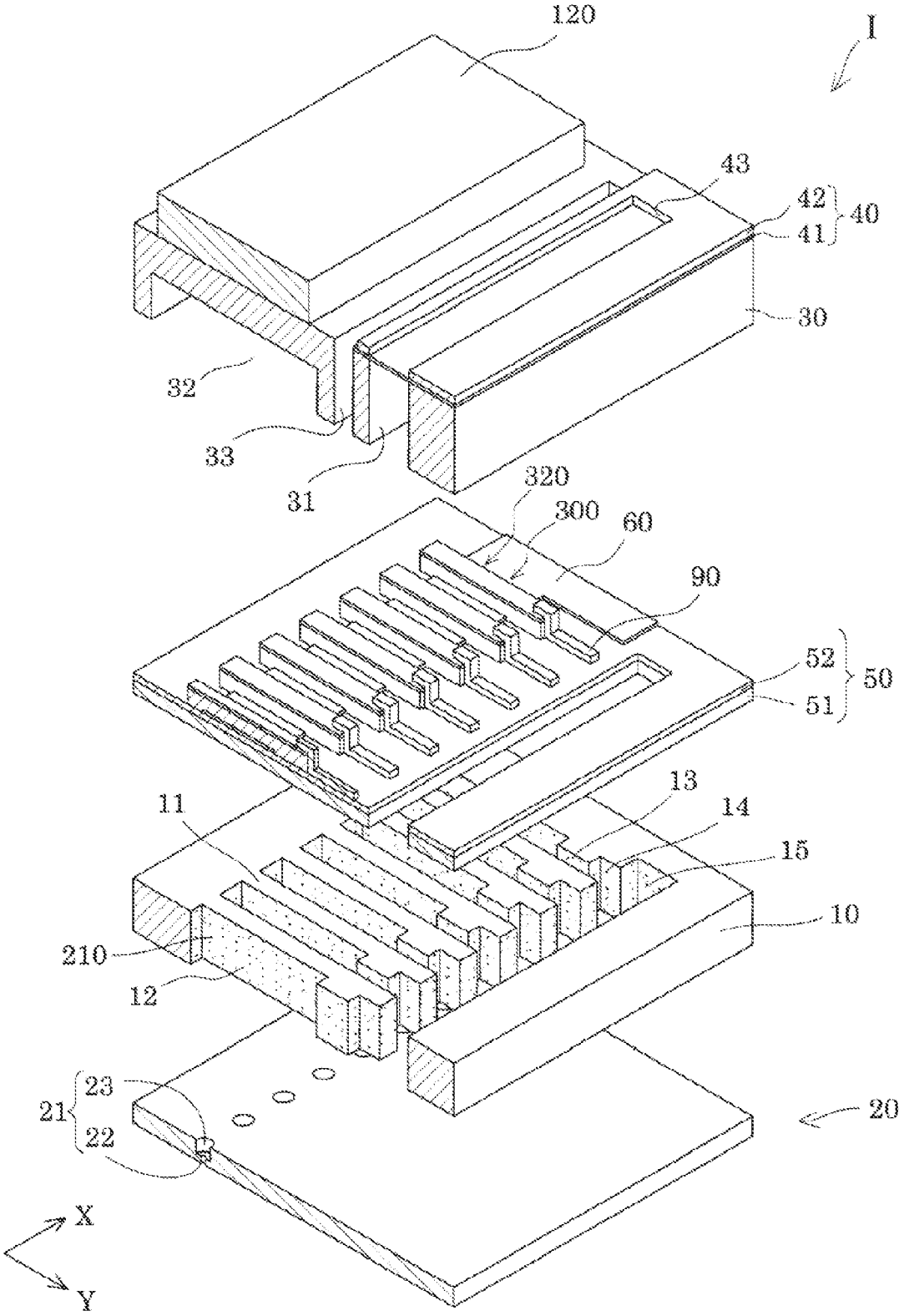
FIG. 3 is an exploded perspective view of a recording head according to Embodiment 2.
Figure 4A:
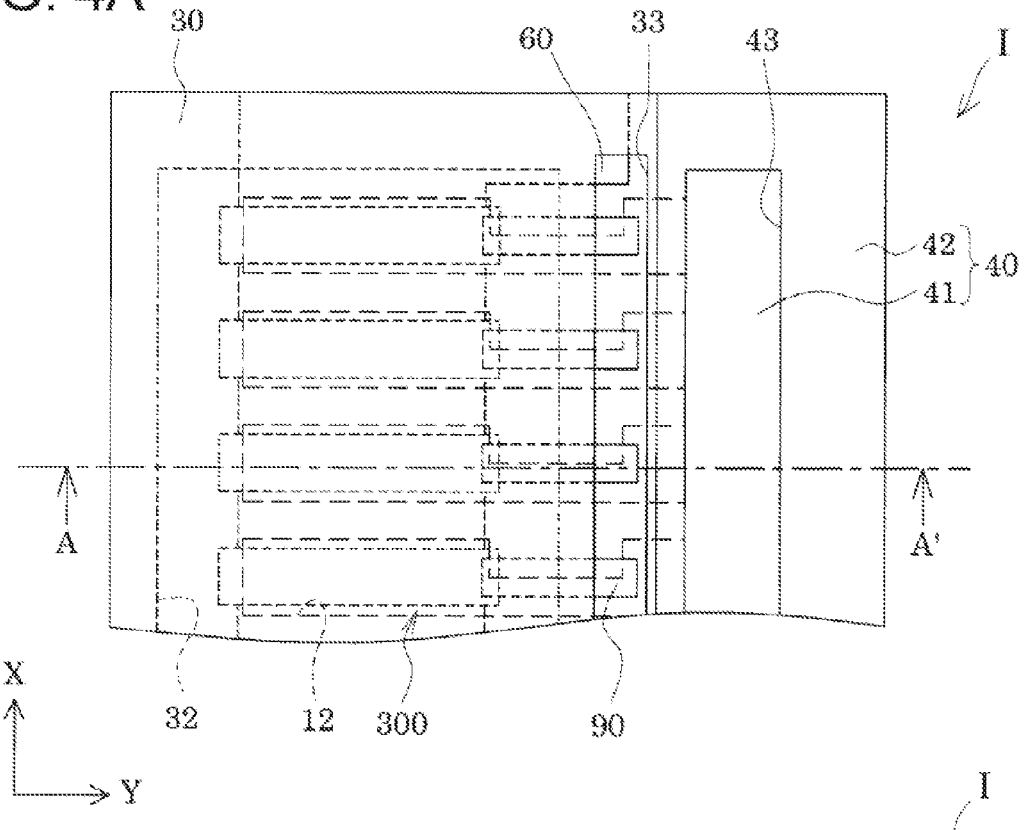
FIGS. 4A and 4B are a plan view and a cross-sectional view of the recording head according to Embodiment 2.
Figure 4B:
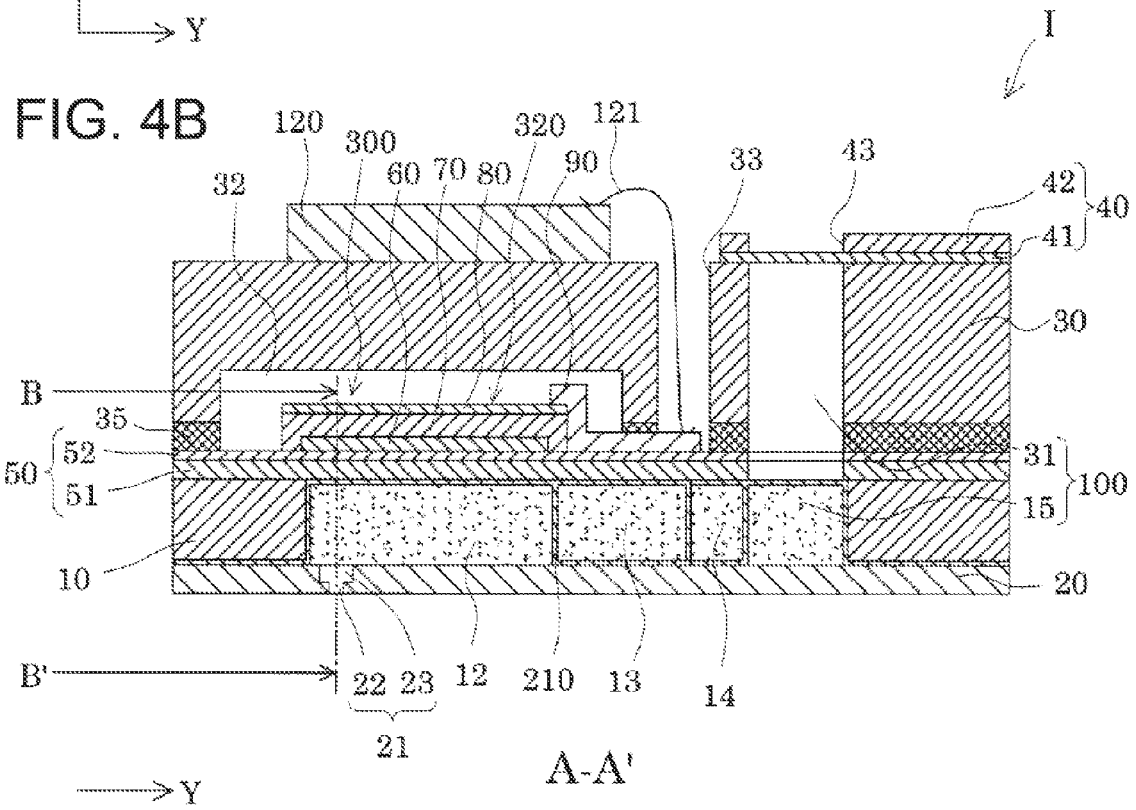
Figure 5:
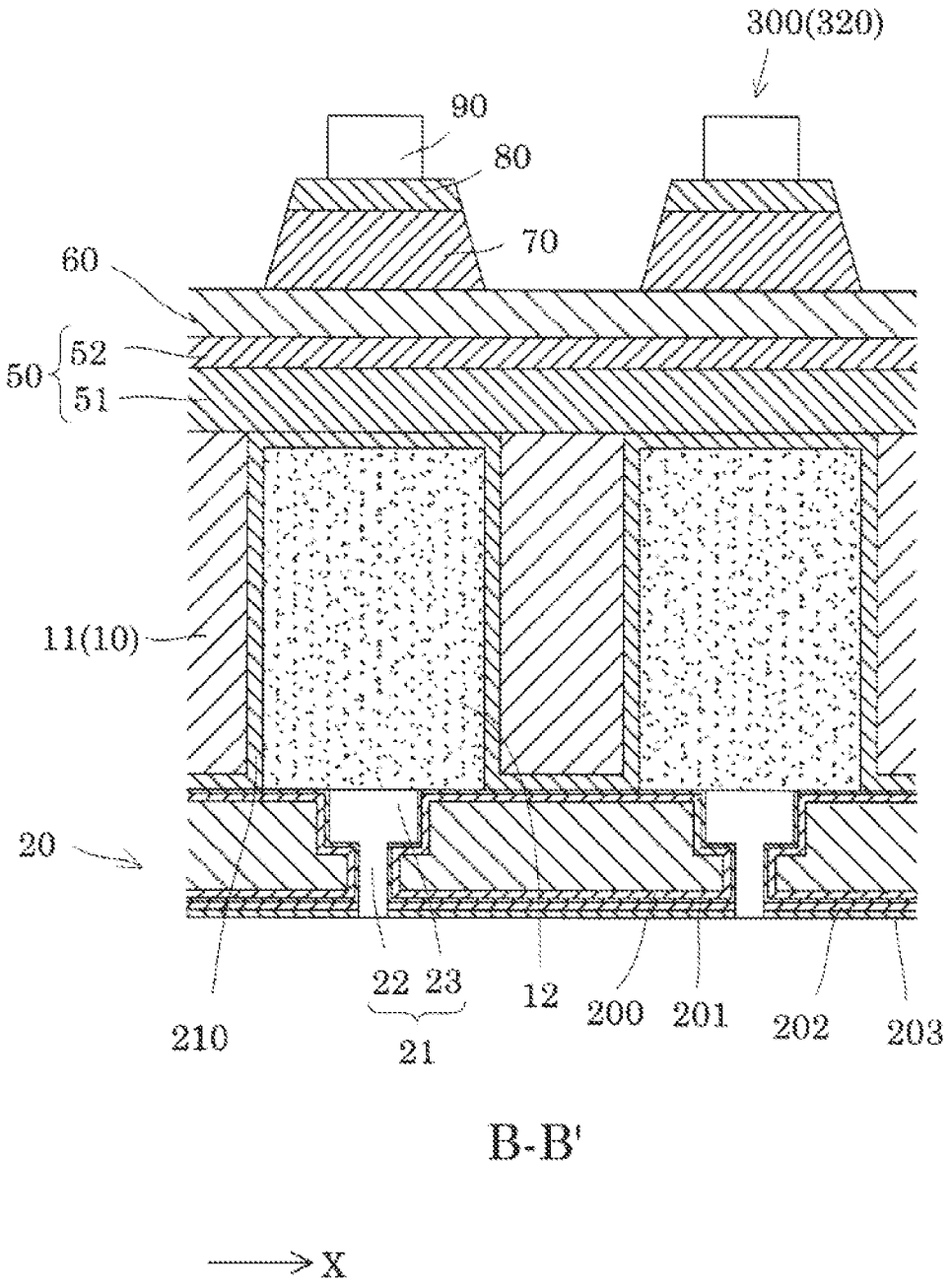
FIG. 5 is a cross-sectional view of the recording head according to Embodiment 2.

FIG. 3 is an exploded perspective view of the ink jet type recording head of this embodiment, FIG. 4A is a plan view of FIG. 3 and FIG. 4B is a cross-sectional view taken along line A-A' of FIG. 4A, and FIG. 5 is a cross-sectional view taken along line B-B' of FIG. 4B.

As shown in the drawings, a passage forming substrate 10 of an ink jet type recording head I which is an example of the liquid ejecting head of this embodiment is formed from, for example, a silicon single crystal substrate in this embodiment. In the passage forming substrate 10, pressure generating chambers 12 that are partitioned by a plurality of partition walls 11 are arranged along a direction in which a plurality of nozzle openings 21 discharging ink of the same color are arranged. Hereinafter, this direction is referred to as an arrangement direction of the pressure generating chambers 12 or a first direction X. Also, hereinafter, a direction that is orthogonal to the first direction X is referred to as a second direction Y.

Ink supply paths 13 and communication paths 14 are partitioned by the plurality of partition walls 11 on one longitudinal direction end portion side of the pressure generating chambers 12 of the passage forming substrate 10, that is, one second direction Y end portion side orthogonal to the first direction X. Outside (opposite side from the pressure generating chambers 12 in the second direction Y) the communication paths 14, a communication portion 15 that constitutes a part of a manifold 100 which is a common ink chamber (liquid chamber) of the pressure generating chambers 12 is formed. In other words, a liquid passage formed from the pressure generating chambers 12, the ink supply paths 13, the communication paths 14, and the communication portion 15 is formed in the passage forming substrate 10.

Herein, a liquid-resistant film 210 that is formed of a material having ink resistance (liquid resistance), for example, tantalum oxide (TaOx; amorphous) such as tantalum pentoxide, is disposed on an inner wall surface (inner surface) of the liquid passage of the passage forming substrate 10 formed from the pressure generating chambers 12, the ink supply paths 13, the communication paths 14, and the communication portion 15. A material of the liquid-resistant film 210 is not limited to tantalum oxide but, for example, oxide silicon ($SiO_2$), zirconium oxide ($ZrO_2$), hafnium oxide ($HfO_2$), nickel (Ni), chromium (Cr), and the like may be used depending on the pH value of the ink which is used.

The liquid-resistant film 210 can be formed by a gas phase method such as a sputtering method and an atomic layer deposition (ALD) method but, particularly, it is preferable that the liquid-resistant film 210 be formed by using the atomic layer deposition (ALD) method. By the atomic layer deposition method, the liquid-resistant film 210 can be formed to have a relatively thin film thickness and high film density. In other words, the ink resistance (liquid resistance) of the liquid-resistant film 210 can be improved and erosion of a vibration plate 50, the passage forming substrate 10, and the like by ink (liquid) can be suppressed by forming the liquid-resistant film 210 with high film density. Accordingly, the thickness of the liquid-resistant film 210 can be reduced. Also, compared to the CVD method and the like, the liquid-resistant film 210 can be formed to be thin by the atomic layer deposition method. However, the film formation by the atomic layer deposition method is time-consuming compared to the sputtering method and is not suitable for formation of a thick film.

The nozzle plate 20 of Embodiment 1 in which the nozzle openings 21 respectively communicating with the pressure generating chambers 12 are formed is bonded to one surface side of the passage forming substrate 10, that is, a surface where the liquid passage of the pressure generating chambers 12 and the like is open, by an adhesive agent, a heat welding film, or the like. In other words, the nozzle openings 21 are arranged in the first direction X on the nozzle plate 20.

An elastic film 51 that is formed of oxide silicon ($SiO_2$) formed by thermal oxidation, and an insulator layer 52 that is formed on the elastic film 51 and is formed of a material containing zirconium oxide ($ZrO_2$) are stacked on the other surface side of the passage forming substrate 10. The liquid passage of the pressure generating chambers 12 and the like is formed by anisotropic etching of the passage forming substrate 10 from the one surface side (surface side bonded with the nozzle plate 20), and the other surface of the liquid passage of the pressure generating chambers 12 and the like is defined by the elastic film 51.

Piezoelectric actuators 300 that have a first electrode 60, piezoelectric layers 70, and second electrodes are formed on the insulator layer 52. Herein, the piezoelectric actuator 300 refers to a part that has the first electrode 60, the piezoelectric layers 70, and the second electrodes 80 and, in general, is configured by any one electrode of the piezoelectric actuator 300 being a common electrode and by patterning the other electrode and the piezoelectric layer 70 for each of the pressure generating chambers 12. Herein, a part that is configured to have any one patterned electrode and the piezoelectric layer 70 and where piezoelectric distortion is generated by voltage application to both of the electrodes is referred to as a piezoelectric active portion 320. In this embodiment, the first electrode 60 is the common electrode of the piezoelectric actuator 300 and the second electrode 80 is an individual electrode of the piezoelectric actuator 300, but this may be reversed for drive circuit and wiring convenience.

The piezoelectric layer 70 is formed of a piezoelectric material of oxide having a polarized structure formed on the first electrode 60 and, for example, can be formed of perovskite type oxide expressed by the general expression of $ABO_3$, in which A can contain lead and B can contain at least either one of zirconium and titanium. The above-described B can, for example, further contain niobium. Specifically, for example, lead zirconate titanate ($Pb(Zr, Ti)O_3$: PZT), silicon-containing lead zirconate titanate niobate ($Pb(Zr, Ti, Nb)O_3$: PZTNS), and the like can be used as the piezoelectric layer 70.

The piezoelectric layer 70 may be a composite oxide or the like that has a perovskite structure containing a lead-free piezoelectric material not containing lead, for example, bismuth ferrite and bismuth manganese ferrite, and barium titanate and bismuth potassium titanate.

Further, a lead electrode 90 that is drawn out from the vicinity of an ink supply path 13 side end portion and extends onto the vibration plate 50, which is formed of, for example, gold (Au), is connected to each of the second electrodes 80 which is the individual electrode of the piezoelectric actuator 300.

A protective substrate 30 that has a manifold portion 31 constituting at least a part of the manifold 100 is bonded via an adhesive agent 35 onto the passage forming substrate 10 where the piezoelectric actuator 300 is formed in this manner, that is, onto the first electrode 60, the vibration plate 50, and the lead electrode 90. In this embodiment, the manifold portion 31 penetrates the protective substrate 30 in a thickness direction and is formed across a width direction of the pressure generating chamber 12 and, as described above, communicates with the communication portion 15 of the passage forming substrate 10 to constitute the manifold 100 that is a common ink chamber of the pressure generating chambers 12. Also, only the manifold portion 31 may be the manifold by dividing the communication portion 15 of the passage forming substrate 10 into a plurality of portions for the pressure generating chambers 12. Further, for example, only the pressure generating chambers 12 maybe disposed in the passage forming substrate 10 and the ink supply path 13 that causes the manifold and each of the pressure generating chambers 12 to communicate with each other may be disposed in the vibration plate 50 that is interposed between the passage forming substrate 10 and the protective substrate 30.

A piezoelectric actuator holding unit 32 that has a space to an extent to which a movement of the piezoelectric actuator 300 is not inhibited is disposed in an area of the protective substrate 30 opposing the piezoelectric actuator 300. The piezoelectric actuator holding unit 32 may have the space to the extent to which the movement of the piezoelectric actuator 300 is not inhibited, and the space may be sealed or may not be sealed.

A through-hole 33 that penetrates the protective substrate 30 in the thickness direction is disposed in the protective substrate 30. The vicinity of an end portion of the lead electrode 90 that is drawn out from each of the piezoelectric actuators 300 is disposed to be exposed into the through-hole 33.

A drive circuit 120 that functions as a signal processing unit is fixed onto the protective substrate 30. For example, a circuit substrate, a semiconductor integrated circuit (IC), and the like can be used as the drive circuit 120. The drive circuit 120 and the lead electrode 90 are electrically connected to each other via connection wiring 121 that is formed of a conductive wire such as a bonding wire which is inserted into the through-hole 33.

Preferably, a material of the protective substrate 30 has a coefficient of thermal expansion substantially equal to a coefficient of thermal expansion of the passage forming substrate 10 such as glass and a ceramic material and, in this embodiment, the material is a silicon single crystal substrate which is the same material as the passage forming substrate 10.

A compliance substrate 40 that is formed from a sealing film 41 and a fixed plate 42 is bonded onto the protective substrate 30. Herein, the sealing film 41 is formed of a low-rigidity material having flexibility, for example, a polyphenylene sulfide (PPS) film, and one surface of the manifold portion 31 is sealed by the sealing film 41. The fixed plate 42 is formed of a hard material such as metal, for example, stainless steel (SUS). An area of the fixed plate 42 opposing the manifold 100 has an opening portion 43 that is completely removed in the thickness direction, and thus one surface of the manifold 100 is sealed only by the sealing film 41 that has flexibility.

In the ink jet type recording head I of this embodiment, ink is taken in from an ink introduction port connected to an outer ink supply unit which is not shown and an inner portion ranging from the manifold 100 to the nozzle openings 21 is filled with the ink, then voltage is applied between each of the first electrode 60 and the second electrodes corresponding to the pressure generating chambers 12 according to a recording signal from the drive circuit 120, and the vibration plate 50, the first electrode 60, and the piezoelectric layer 70 are deflected such that pressure within each of the pressure generating chambers 12 is increased and ink drops are discharged from the nozzle openings 21.

As described above, the ink jet type recording head I of this embodiment includes the nozzle plate 20 of Embodiment 1, and thus has excellent ink resistance and can uniformly discharge ink drops. In other words, the protective film 201 that is formed from the tantalum oxide film which is formed by atomic layer deposition is formed on both of the surfaces of the nozzle plate 20 and the inner circumferential surface of the nozzle opening 21, and the plasma-polymerized film 202 and the liquid-repellent film 203 are formed on the discharge surface thereon such that the uniform protective film 201 formed from the tantalum oxide film is formed on an inner surface of the nozzle opening 21, particularly up to the vicinity of the discharge surface to have excellent ink resistance. The protective film 201 that is formed from the tantalum oxide film is formed to be uniform and into a relatively thin film on the inner circumferential surface of the nozzle opening 21 such that there is no problem of non-uniformity of the discharged ink drops.

Another Embodiment

Hereinabove, Embodiments 1 and 2 of the invention have been described, but a basic configuration of the invention is not limited to the above description.

In Embodiment 2 described above, the thin film type piezoelectric actuator 300 is used as a pressure generation unit that discharges ink drops from the nozzle openings 21, but the invention is not limited thereto. For example, a thick film type piezoelectric actuator formed by a method of attaching a green sheet or the like, and a longitudinal vibration type piezoelectric actuator in which a piezoelectric material and an electrode forming material are alternately stacked and are extended and retracted in an axial direction may be used.

In Embodiment 2 described above, the thin film type piezoelectric actuator 300 is used as the pressure generation unit that generates a pressure change in the pressure generating chamber 12, but the invention is not limited thereto. For example, the thick film type piezoelectric actuator formed by the method of attaching the green sheet or the like, the longitudinal vibration type piezoelectric actuator in which the piezoelectric material and the electrode forming material are alternately stacked and are extended and retracted in the axial direction, and the like may be used. Also, as the pressure generation unit, what discharges liquid drops from a nozzle opening by using bubbles generated by heat generation of a heat generating element arranged in a pressure generating chamber, a so-called electrostatic actuator that generates static electricity between a vibration plate and an electrode, deforms the vibration plate by electrostatic force, and discharges liquid drops from a nozzle opening, and the like can be used.

In Embodiment 2 described above, the silicon single crystal substrate is used as an example of the passage forming substrate 10, but the invention is not limited thereto. For example, a material such as an SOI substrate and glass may be used.

Figure 6:
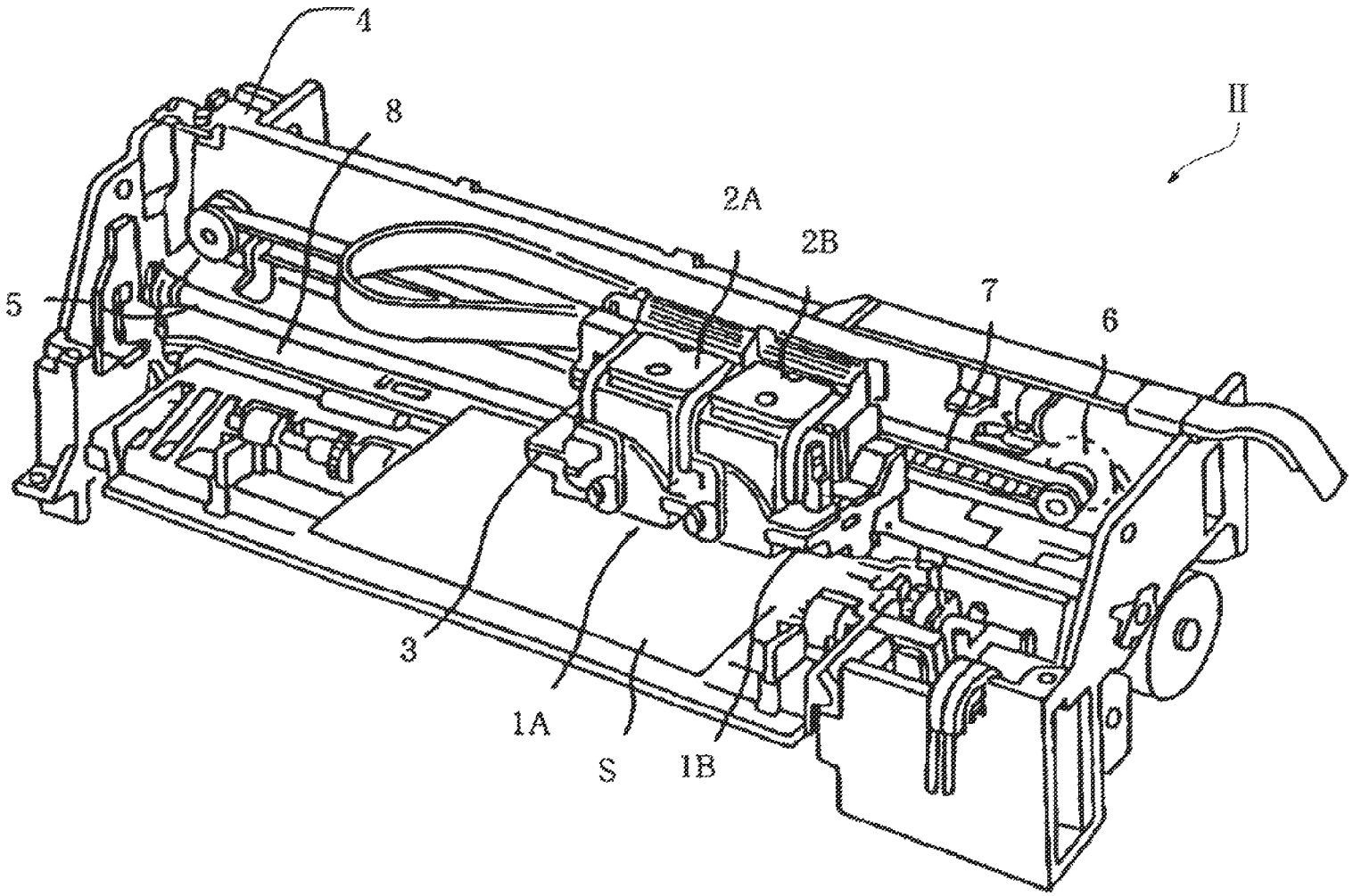
FIG. 6 is a schematic structural view of a recording apparatus according to an embodiment.

In addition, the ink jet type recording head of each of the embodiments constitutes a part of a recording head unit including an ink passage communicating with an ink cartridge and the like, and is mounted on inkjet type recording apparatus. FIG. 6 is a schematic view showing an example of the ink jet type recording apparatus.

As shown in FIG. 6, recording head units 1A and 1B including the inkjet type recording head are disposed in such a manner that cartridges 2A and 2B constituting the ink supply unit are removable. A carriage 3 on which the recording head units 1A and 1B are mounted is disposed in a carriage shaft 5 installed in an apparatus main body 4 in an axially movable manner. The recording head units 1A and 1B respectively discharge, for example, a black ink composition and a color ink composition.

When drive force of a drive motor 6 is transmitted to the carriage 3 via a plurality of not-shown gears and a timing belt 7, the carriage 3 on which the recording head units 1A and 1B are mounted is moved along the carriage shaft 5. A platen 8 is disposed in the apparatus main body 4 along the carriage shaft 5, and a recording sheet S that is a recording medium such as paper which is fed by a not-shown paper feed roller or the like is transported wound around the platen 8.

In addition, in the above-described ink jet type recording apparatus II, the ink jet type recording head I (recording head units 1A and 1B) is mounted on the carriage 3 and is moved in a main scanning direction, but the invention is not limited thereto. For example, the invention can also be applied to a so-called line type recording apparatus in which the ink jet type recording head I is fixed and printing is performed only by moving the recording sheet S such as paper in a sub-scanning direction.

In the above-described embodiments, the inkjet type recording head is used as an example of the liquid ejecting head and the ink jet type recording apparatus is used as an example of the liquid ejecting apparatus. However, the invention covers a wide variety of liquid ejecting heads and liquid ejecting apparatuses and, as a matter of course, can be applied to liquid ejecting heads and liquid ejecting apparatuses ejecting liquids other than ink. Examples of the other liquid ejecting heads include various types of recording heads used in image recording apparatuses such as printers, coloring material ejecting heads used in manufacturing color filters such as liquid crystal displays, electrode material ejecting heads used in forming electrodes such as organic EL displays, field emission displays (FED), and bio-organic material ejecting heads used in manufacturing biochips. The invention can also be applied to liquid ejecting apparatuses including such liquid ejecting heads.

The entire disclosure of Japanese Patent Application No. 2012-284496, filed Dec. 27, 2012 is expressly incorporated by reference herein.

What is claimed is:

1. A nozzle plate comprising:

a silicon substrate;

a plurality of nozzle openings which are disposed in the silicon substrate, wherein each nozzle opening includes a first portion having a first diameter and a second portion having a second diameter;

a tantalum oxide film which is formed by atomic layer deposition and disposed on both surfaces of the silicon substrate and an inner circumferential surface of the first portion and the second portion of the nozzle opening, wherein a thickness of the tantalum oxide film is within a range of 0.3 Å to 50 nm; and a plasma-polymerized film of a silicone material which is stacked on the tantalum oxide film of a discharge surface.

2. The nozzle plate according to claim 1, wherein the tantalum oxide film is formed such that approximately 7 g of tantalum oxide are deposited per square centimeter of the surfaces of the silicon substrate and the inner surface of the nozzle opening.

3. The nozzle plate according to claim 1, wherein a silicon thermal oxide film is formed between the silicon substrate and the tantalum oxide film.

4. The nozzle plate according to claim 1, wherein a liquid-repellent film is stacked on the plasma-polymerized film of the silicone material through annealing of a metal alkoxide film.

5. A liquid ejecting head comprising:

the nozzle plate according to claim 1;

a passage forming substrate that is bonded with the nozzle plate, wherein a pressure generating chamber is disposed in the passage forming substrate and communicates with the nozzle opening; and a pressure generation unit that is disposed on an opposite side to the nozzle plate of the passage forming substrate to generate a pressure change in the pressure generating chamber.

6. A liquid ejecting head comprising:

the nozzle plate according to claim 2;

a passage forming substrate that is bonded with the nozzle plate, wherein a pressure generating chamber is disposed in the passage forming substrate and communicates with the nozzle opening; and a pressure generation unit that is disposed on an opposite side to the nozzle plate of the passage forming substrate to generate a pressure change in the pressure generating chamber.

7. A liquid ejecting head comprising:

the nozzle plate according to claim 3;

a passage forming substrate that is bonded with the nozzle plate, wherein a pressure generating chamber is disposed in the passage forming substrate and communicates with the nozzle opening; and a pressure generation unit that is disposed on an opposite side to the nozzle plate of the passage forming substrate to generate a pressure change in the pressure generating chamber.

8. A liquid ejecting head comprising:

the nozzle plate according to claim 4;

a passage forming substrate that is bonded with the nozzle plate, wherein a pressure generating chamber is disposed in the passage forming substrate and communicates with the nozzle opening; and a pressure generation unit that is disposed on an opposite side to the nozzle plate of the passage forming substrate to generate a pressure change in the pressure generating chamber.

9. A liquid ejecting apparatus comprising the liquid ejecting head according to claim 5.

10. A liquid ejecting apparatus comprising the liquid ejecting head according to claim 6.

11. A liquid ejecting apparatus comprising the liquid ejecting head according to claim 7.

12. A liquid ejecting apparatus comprising the liquid ejecting head according to claim 8.

* * * * *